US011618277B1

(12) United States Patent
Wojciechowski et al.

(10) Patent No.: US 11,618,277 B1
(45) Date of Patent: Apr. 4, 2023

(54) VARIABLE RADIUS ARC SCRIBING ARRANGEMENT FOR A FRAMING SQUARE

(71) Applicant: Johnson Level & Tool Mfg. Co., Inc., Mequon, WI (US)

(72) Inventors: Timothy J. Wojciechowski, Hubertus, WI (US); David Mencel, Menomonee Falls, WI (US)

(73) Assignee: Johnson Level & Tool Mfg. Co., Inc., Mequon, WI (US)

( * ) Notice: Subject to any disclaimer, the term of this patent is extended or adjusted under 35 U.S.C. 154(b) by 0 days.

(21) Appl. No.: 17/490,513

(22) Filed: Sep. 30, 2021

Related U.S. Application Data

(60) Provisional application No. 63/112,949, filed on Nov. 12, 2020.

(51) Int. Cl.
*B43L 7/027* (2006.01)
*B43L 7/00* (2006.01)
*B25H 7/04* (2006.01)

(52) U.S. Cl.
CPC ..... *B43L 7/027* (2013.01); *B25H 7/04* (2013.01); *B43L 7/005* (2013.01)

(58) Field of Classification Search
CPC ..... B43L 7/027; B43L 7/005; B25H 7/04
See application file for complete search history.

(56) References Cited

U.S. PATENT DOCUMENTS

| | | | | |
|---|---|---|---|---|
| 5,669,149 | A * | 9/1997 | Meitzler | G01B 3/56 33/417 |
| 5,915,806 | A | 6/1999 | Levee | |
| 6,049,990 | A * | 4/2000 | Holland | B43L 7/02 33/468 |
| 6,122,834 | A * | 9/2000 | Rester | B25H 7/02 33/780 |
| 6,260,283 | B1 | 7/2001 | Abernathy et al. | |
| 6,591,511 | B1 * | 7/2003 | Carroll | B25H 7/00 33/417 |
| 6,725,555 | B1 | 4/2004 | Moore | |
| 6,868,616 | B2 * | 3/2005 | Allemand | E04D 15/025 33/476 |
| 7,188,427 | B2 | 3/2007 | Johnson | |
| 7,228,636 | B1 | 6/2007 | Moore | |
| 7,464,476 | B2 | 12/2008 | Le | |
| 7,743,523 | B2 | 6/2010 | O'Morrow, Sr. | |
| 7,797,842 | B2 * | 9/2010 | Fernandes | B43L 9/007 33/473 |

(Continued)

*Primary Examiner* — Yaritza Guadalupe-McCall
(74) *Attorney, Agent, or Firm* — Boyle Fredrickson, S.C.

(57) ABSTRACT

A layout tool for scribing an arc includes an arm, a variable location pivot point arrangement on the arm, and a plurality of mark openings spaced from the pivot point arrangement. A position fixing member, such as a nail, is engaged with the pivot point arrangement to fix the position of the tool on a workpiece at a pivot point defined by the position fixing member. A marking instrument is engaged within one of the mark openings, and the tool is pivoted on the workpiece about the pivot point to make an arcuate mark on the workpiece at a radius defined by the location of the position fixing member relative to the mark opening within which the marking instrument is engaged. The tool may be a square, which is configured with two arms that extend away from each other at a predetermined angle.

16 Claims, 8 Drawing Sheets

(56) References Cited

U.S. PATENT DOCUMENTS

| | | | | |
|---|---|---|---|---|
| 7,975,395 | B2 * | 7/2011 | Keller | B43L 7/027 33/474 |
| 8,458,916 | B2 * | 6/2013 | Aplin | B43L 9/007 33/485 |
| 8,826,556 | B2 | 9/2014 | Roth | |
| D738,234 | S | 9/2015 | Larson | |
| 9,121,688 | B1 * | 9/2015 | Schmid | B25H 7/02 |
| D779,979 | S | 2/2017 | Eisinger | |
| 9,599,447 | B2 | 3/2017 | Cruickshanks | |
| 10,001,370 | B2 | 6/2018 | Foster | |
| 10,094,167 | B2 * | 10/2018 | Odish | E06B 9/266 |
| 10,532,603 | B2 * | 1/2020 | Hummel | B25H 7/02 |
| 11,110,739 | B2 * | 9/2021 | Mackey | B25H 7/02 |
| 2009/0013546 | A1 * | 1/2009 | Keller | B43L 7/027 33/474 |
| 2013/0227846 | A1 * | 9/2013 | Buzzell | B43L 7/0275 33/32.2 |
| 2017/0328128 | A1 * | 11/2017 | Odish | G01C 9/28 |
| 2019/0329586 | A1 * | 10/2019 | Mackey | B43L 13/00 |

* cited by examiner

30

| | 13" | 14" | 15" | 16" | 17" | 18" | 19" | 20" | 21" | 22" |
|---|---|---|---|---|---|---|---|---|---|---|
| 0 | P-6 | H-6 | P-7 | H-7 | P-8 | H-8 | P-9 | H-9 | P-10 | H-10 |
| 1/8" | O-6 | G-6 | O-7 | G-7 | O-8 | G-8 | O-9 | G-9 | O-10 | G-10 |
| 1/4" | N-6 | F-6 | N-7 | F-7 | N-8 | F-8 | N-9 | F-9 | N-10 | F-10 |
| 3/8" | M-6 | E-6 | M-7 | E-7 | M-8 | E-8 | M-9 | E-9 | M-10 | E-10 |
| 1/2" | L-6 | D-6 | L-7 | D-7 | L-8 | D-8 | L-9 | D-9 | L-10 | D-10 |
| 5/8" | K-6 | C-6 | K-7 | C-7 | K-8 | C-8 | K-9 | C-9 | K-10 | C-10 |
| 3/4" | J-6 | B-6 | J-7 | B-7 | J-8 | B-8 | J-9 | B-9 | J-10 | B-10 |
| 7/8" | I-6 | A-6 | I-7 | A-7 | I-8 | A-8 | I-9 | A-9 | I-10 | A-10 |

VARIABLE RADIUS ARC SCRIBING ARRANGEMENT FOR A FRAMING SQUARE

CROSS-REFERENCE TO RELATED APPLICATION

This application claims the benefit of U.S. provisional patent application Ser. No. 63/112,949 filed Nov. 12, 2020, the entire disclosure of which is hereby incorporated by reference.

BACKGROUND AND SUMMARY

The present disclosure relates generally to framing tools for use in construction layout, and more specifically to a variable radius arc scribing arrangement for a framing tool such as a framing square.

Various tools are known for use in marking and layout in construction applications. One such tool is a square, which commonly has a pair of blades or arms that extend away from each other at a predetermined angle. Each arm of a square is typically provided with measurement indicia along its length, in a manner as is known.

Construction layout typically involves marking various lines on workpieces according to a plan. When a plan calls for making an arcuate cut on a workpiece, making an arcuate mark on the workpiece to indicate where the cut should be made can be challenging. A compass may be employed, as can various tricks of the trade that might be known to more experienced tradesmen. A compass, however, may not be readily available and uncovering methods known to the trade can be challenging, particularly when on-site.

It is an object of the present invention to provide a layout tool, such as a square, that has features that enable it to be used in making arcuate marks on a surface.

In accordance with the present invention, a layout tool includes an elongated planar arm, a variable location pivot point arrangement on the elongated arm, and a series of mark openings formed in the elongated arm at a location spaced from the variable location pivot point arrangement. A position fixing member is adapted to be engaged with the variable location pivot point arrangement to fix the position of the tool on a workpiece at a pivot point defined by the position fixing member. A marking instrument is adapted to be engaged within one of the mark openings, such that pivoting movement of the tool on the workpiece about the pivot point results in the marking instrument making an arcuate mark on the workpiece at a radius defined by the location of the position fixing member relative to the mark opening within which the marking instrument is engaged. The layout tool may be in the form of a square that has first and second elongated planar arms extending at an angle from an end defined by the first elongated planar arm, and the variable location pivot point arrangement may be located toward the intersection of the first and second elongated planar arms.

The variable location pivot point arrangement may be in the form of an opening arrangement located adjacent an end defined by the elongated planar aim. In one form, the opening arrangement may be in the form of a slot extending through the elongated planar arm. The slot may define serrated sides that are configured to receive the position fixing member at discrete locations along a length defined by the slot.

Representatively, the position fixing member may be in the form of a nail, which can be positioned within the slot at a desired location along the length of the slot and driven into the workpiece. The slot and its serrated sides may be configured to receive a conventionally sized and commonly available nail, such as for example an eight-penny nail.

The mark openings are spaced at regularly spaced locations along the length of the elongated planar aim. A predetermined location along the length of the slot corresponds to a predetermined radius relative to each of the mark openings. The length of the slot may correspond to the space between adjacent mark openings, and the slot may be positioned relative to the mark openings such that a midpoint of the slot corresponds to the predetermined radius relative to each of the mark openings. The slot may be configured such that locations along the length of the slot toward the mark openings correspond to fractionally smaller radii relative to the predetermined radius for each of the mark openings, and locations along the length of the slot away from the mark openings correspond to fractionally larger radii relative to the predetermined radius for each of the mark openings.

The disclosure further contemplates a method of marking an arc on a workpiece, substantially in accordance with the foregoing summary.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements can be several views, and in which.

Figure 1:
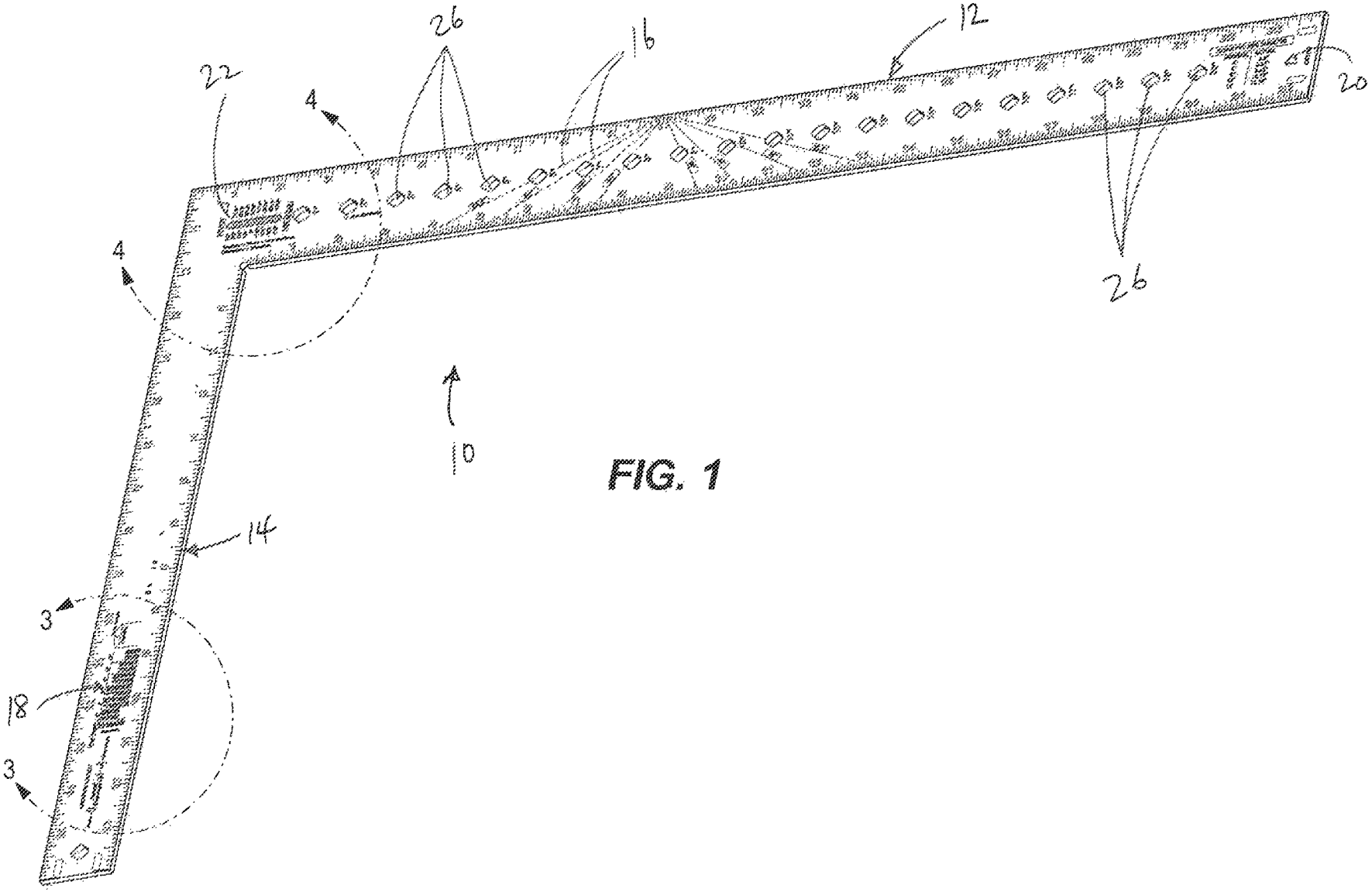
FIG. 1 an isometric view of a layout tool, such as a square, incorporating the variable radius arc scribing feature of the present invention.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected," "attached," or terms similar thereto may be used. They are not limited to direct connection or attachment, but include connection or attachment to other elements where such connection or attachment is recognized as being equivalent by those skilled in the art.

DETAILED DESCRIPTION

The various features and advantageous details of the subject matter disclosed herein are explained more fully with reference to the non-limiting embodiments described in detail in the following description.

Figure 2:
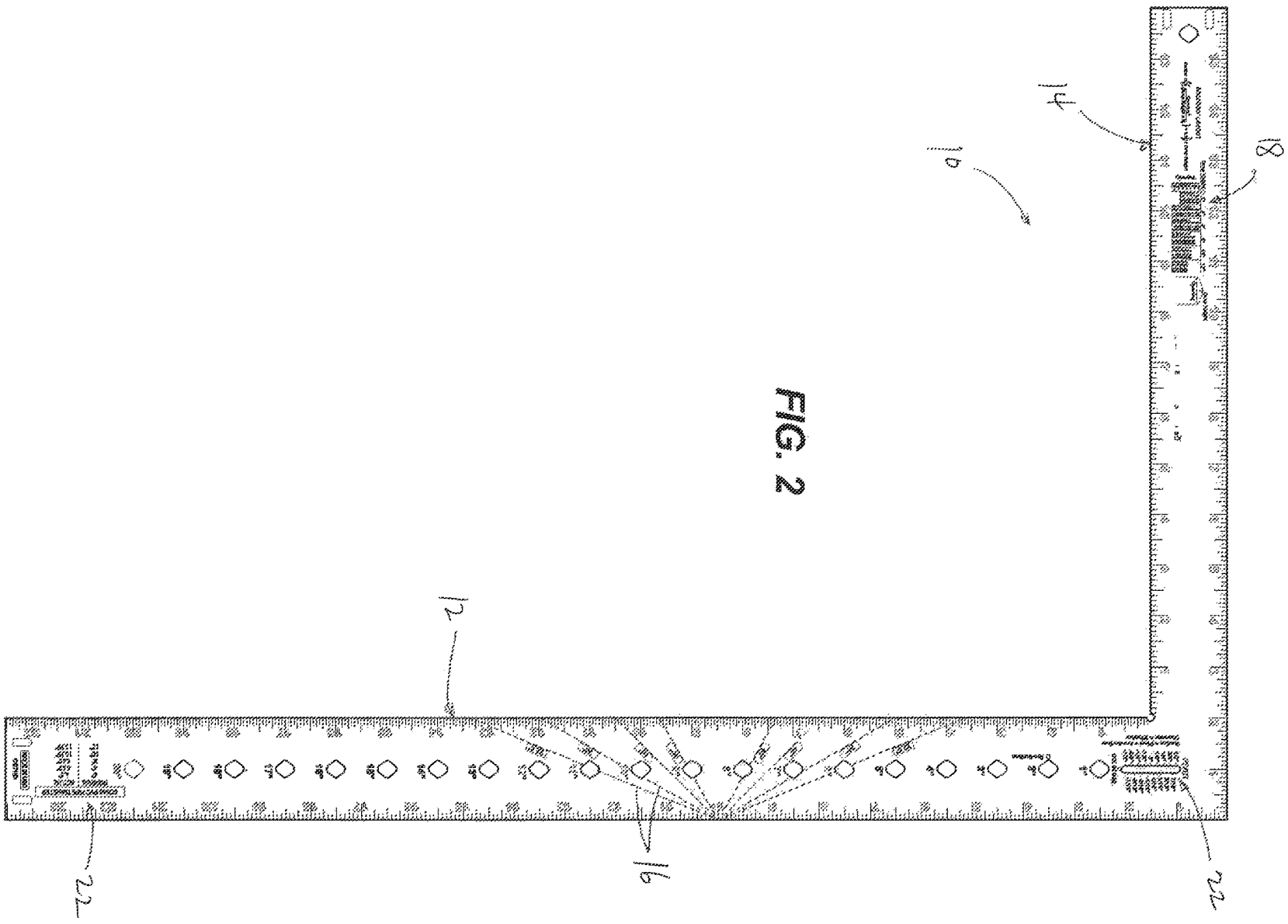
FIG. 2 is a plan view of the layout tool of FIG. 1.
Figure 3:
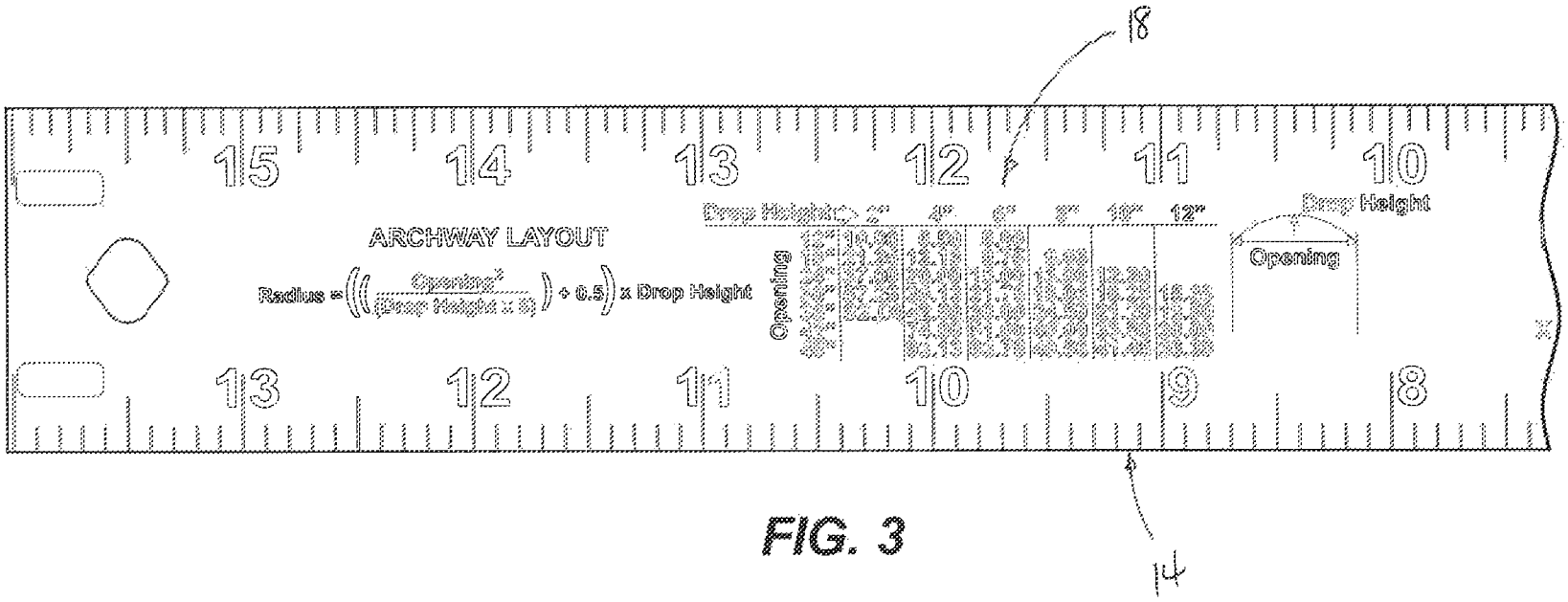
FIG. 3 is an enlarged partial plan view of a portion of the layout tool of FIGS. 1 and 2, with reference to line 3-3 of FIG. 2.

Referring to the following description in which like reference numerals represent like parts throughout the disclosure, FIGS. 1 and 2 illustrate a layout tool in the form of a square 10 incorporating the variable radius arc scribing feature in accordance with the present invention. In the illustrated embodiment, the square 10 defines a first arm or blade 12 and a second arm or blade 14, which are arranged so as to extend perpendicularly relative to each other. It is understood, however, that the arms of the square 10 may be arranged at any desired angle relative to each other. In addition, while the illustrated embodiment shows the arms 12, 14 as being fixed in position relative to each other, it is also contemplated that one of the arms may be movably mounted relative to the other so as to be positionable at various locations along the length of the other arm and so that the angle between the arms may be adjustable.

In a manner as is known, marking indicia are provided along the length of each of the arms 12, 14. A first set of marks is provided on each of arms 12, 14 extending outwardly from the inside corner defined by the arms 12, 14, and a second set of marks is provided on each of the arms 12, 14 extending outwardly from the outside corner defined by the arms 12, 14.

Various other features useful to a user of square 12 are provided on the surfaces of arms 12, 14. For example, in addition to the marking indicia noted above, one of the arms, such as arm 12, may be provided with markings 16 that enable the user to measure angles. A table 18 may be provided to enable user to ascertain certain radii according to differently configured opening and drop height dimensions. A table 20 may be provided as a reference for PVC pipe diameters. Other reference information may be provided on the surfaces of square arms 12, 14 as desired.

Figure 4:
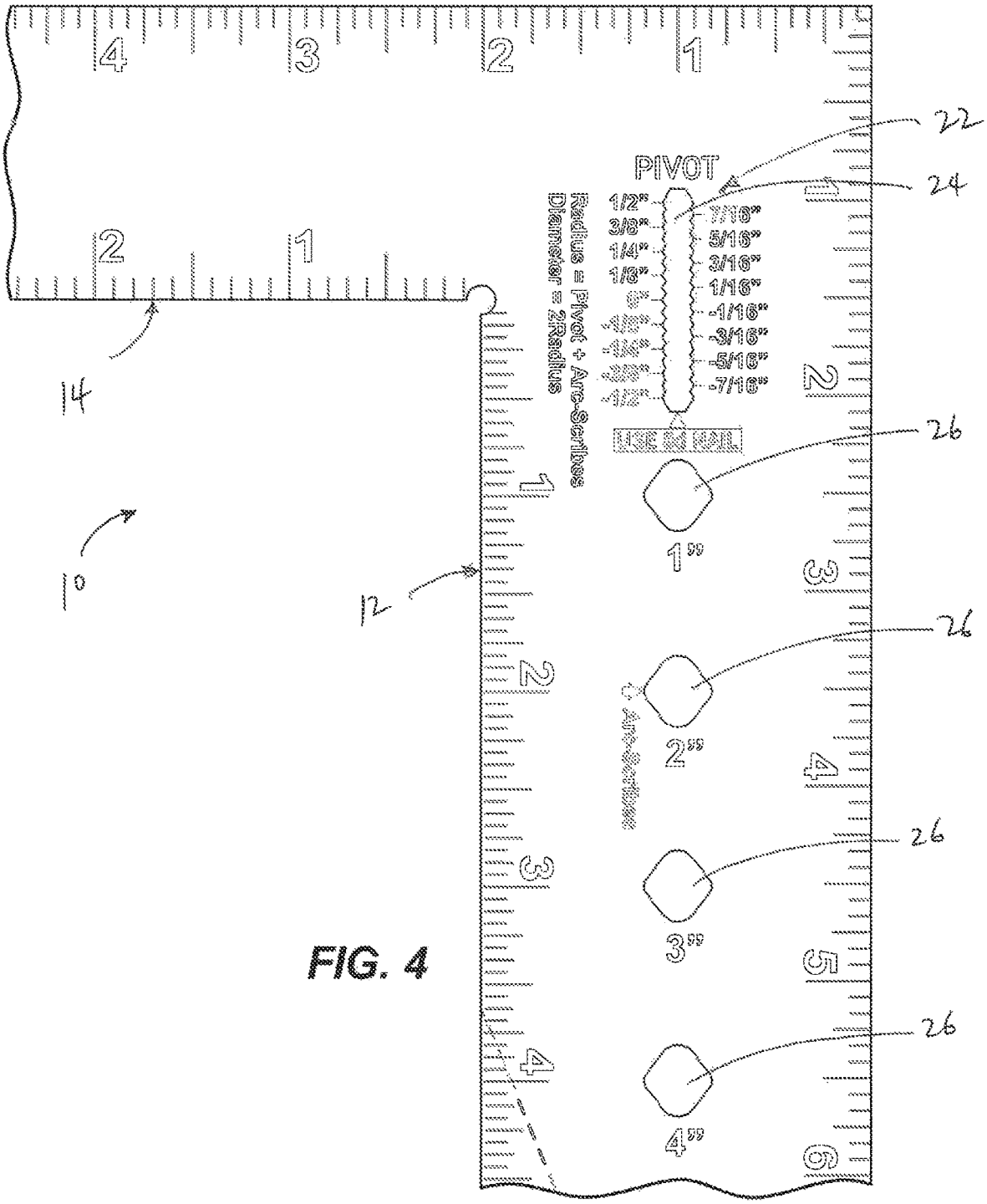
FIG. 4 is an enlarged partial plan view of a portion of the layout tool of FIGS. 1 and 2, with reference to line 4-4 of FIG. 2.

With reference to FIGS. 1, 2 and 4, the square 10 includes a feature in accordance with the present invention that enables the user to make arcuate marks of various radii on a workpiece. In this regard, a variable location pivot point arrangement 22 is located toward the central area of the square 10 at which the arms 12, 14 intersect. In the illustrated embodiment, the variable location pivot point arrangement 22 is in the form of a slot 24 having serrated edges. The slot 24 extends along a longitudinal axis, which in the illustrated embodiment is coincident with a longitudinal axis along which square arm 12 extends. Alternatively, slot 24 may have any other orientation, such as at an angle relative to or offset from and parallel to the longitudinal axis of arm 12. The serrated edges of the slot 24 defined discrete, spaced apart widened areas, and the surface of the arm 12 adjacent the slot 24 is provided with markings that correspond with each widened area of the slot 24. In the illustrated embodiment, the widened areas defined by the serrated edges of the slot 24 are spaced apart from each other by ⅛ inch. It is understood, however, that any satisfactory spacing of the widened areas of slot 24 may be employed. The markings adjacent the slot 24 indicate the ⅛ inch spacing between the widened areas of the slot 24. In the illustrated embodiment, the markings indicate 0" at the center of the slot 24, with +⅛" increments extending outwardly away from the 0" center point of the slot 24 and −⅛" increments extending inwardly away from the 0" center point of the slot 24.

While the illustrated embodiment shows widened areas of a serrated slot for providing discrete locations, it is also contemplated that spaced apart, separate openings may be employed.

In addition, the square 10 includes a series of mark openings 26 along the length of arm 12. The mark openings 26 may be arranged at regular intervals relative to each other, and may extend along generally the entire length of the arm 12. In the illustrated embodiment, the mark openings 26 extend throughout a majority of the length of the arm 12, although it is understood that the mark openings 26 may extend throughout a lesser portion of the length of the arm 12. Also in the illustrated embodiment, the mark openings 26 are spaced apart from each other at 1 inch center-to-center intervals along the length of the arm 12. However, any alternative satisfactory spacing as desired may be employed. The axis along which the mark openings 26 extend is aligned with the longitudinal axis of the slot 24. The mark openings 26 in the illustrated embodiment are generally diamond shaped and sized so as to receive a conventional marking instrument as may be used in construction applications, such as a conventional pencil, lumber pencil, marking crayon or the like. The mark openings 26 may have any other satisfactory configuration as desired. The surface of the square arm 12 adjacent each mark opening 26 indicates the distance at which the center of the mark opening 26 is spaced from the 0" center point of the slot 24.

The function of the serrated edges of the slot 24 is to allow a user to provide a pivot point for the square 10 at a desired location. In this regard, the serrated edges of the slot 24 are spaced apart from each other a distance that enables a position fixing member, such as a nail N, to extended through the slot 24 at discrete, spaced apart locations along the length of the slot 24. For example, the spacing between the serrated edges of the slot 24 may be such that a conventional 8-penny nail can be inserted through the slot 24 at each widened area of the slot 24. The slot 24 is configured such that the narrowed areas defined by the serrated edges do not enable the position fixing member, such as the nail N, to be moved along the length of the slot. That is, the nail N can only be inserted through the slot 24 at one of the discrete, widened areas defined by the serrated edges.

Figure 5:
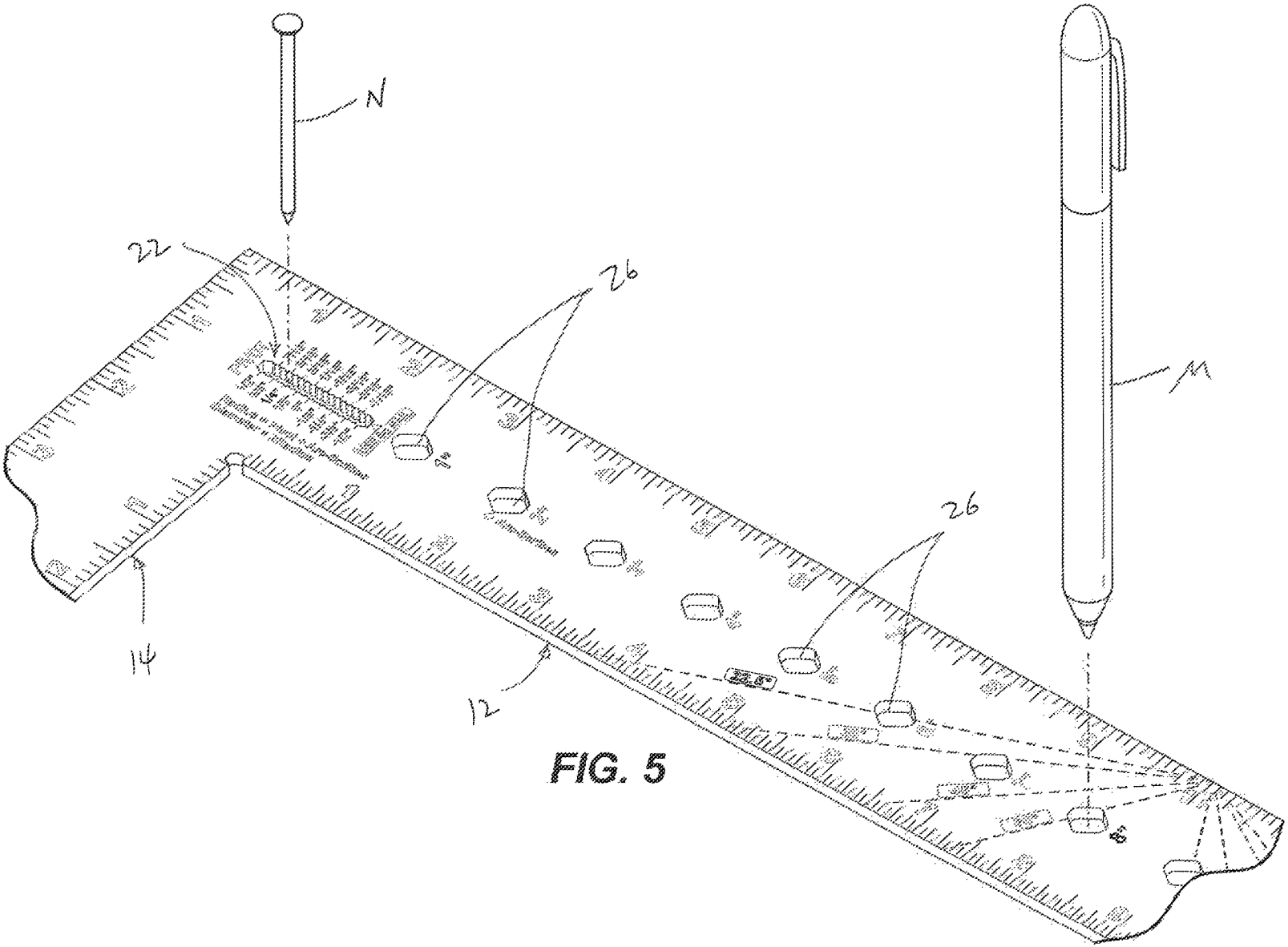
FIG. 5 is a partial isometric view showing a portion of the layout tool of FIGS. 1 and 2, along with a nail and a marking instrument for use in scribing an arcuate mark on a work surface.
Figure 6:
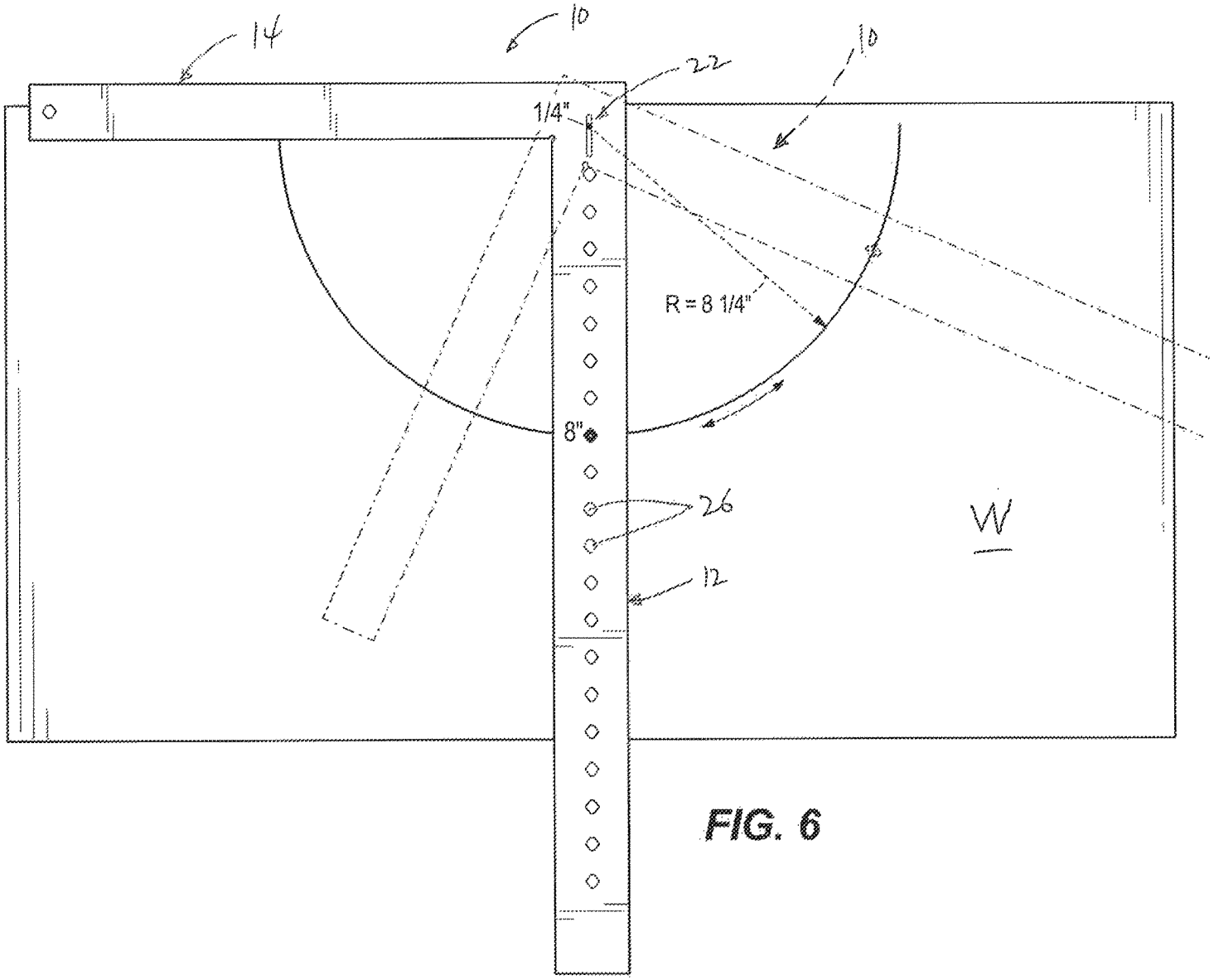
FIG. 6 is a plan view of the layout tool of FIGS. 1 and 2, showing the manner in which an arcuate mark is made on a work surface in accordance with the present invention.

Referring to FIGS. 5 and 6, when the user wishes to make an arcuate mark on a work surface, the user first determines the desired radius of the arcuate mark. In the example illustrated in FIGS. 5 and 6, the desired radius of the arcuate mark is 8¼ inches. The user inserts the nail N through the slot 24 at the widened area of the slot that corresponds to +¼ inch and then drives the nail N into the workpiece, shown at W in FIG. 6. The user then inserts the tip of a marking instrument, shown at M, into the desired mark opening 26, in this case the mark opening at 8". While maintaining the square 10 flat on the workpiece W, the user pivots the square about the pivot point defined by the location at which the nail N is driven into the workpiece W while maintaining the tip of the marking instrument M against the surface of the workpiece W. Such pivoting movement of the square 10 and the tip of the marking instrument M results in an arcuate mark having a radius of 8¼ inches being scribed on the workpiece W.

It can be appreciated that the nail N is inserted through the widened area of the slot 24 corresponding to 0" when an arc having a non-fractional radius is desired. For an arc having a fractional radius less than ½ inch, the widened areas of the slot 24 corresponding to positive (+) fractional locations are employed. For an arc having a fractional radius greater than ½ inch, the user positions the tip of the marking instrument M in the next largest mark opening 26 and then utilizes the widened areas of the slot 24 corresponding to negative (−) fractional locations.

Figures 7, 8:
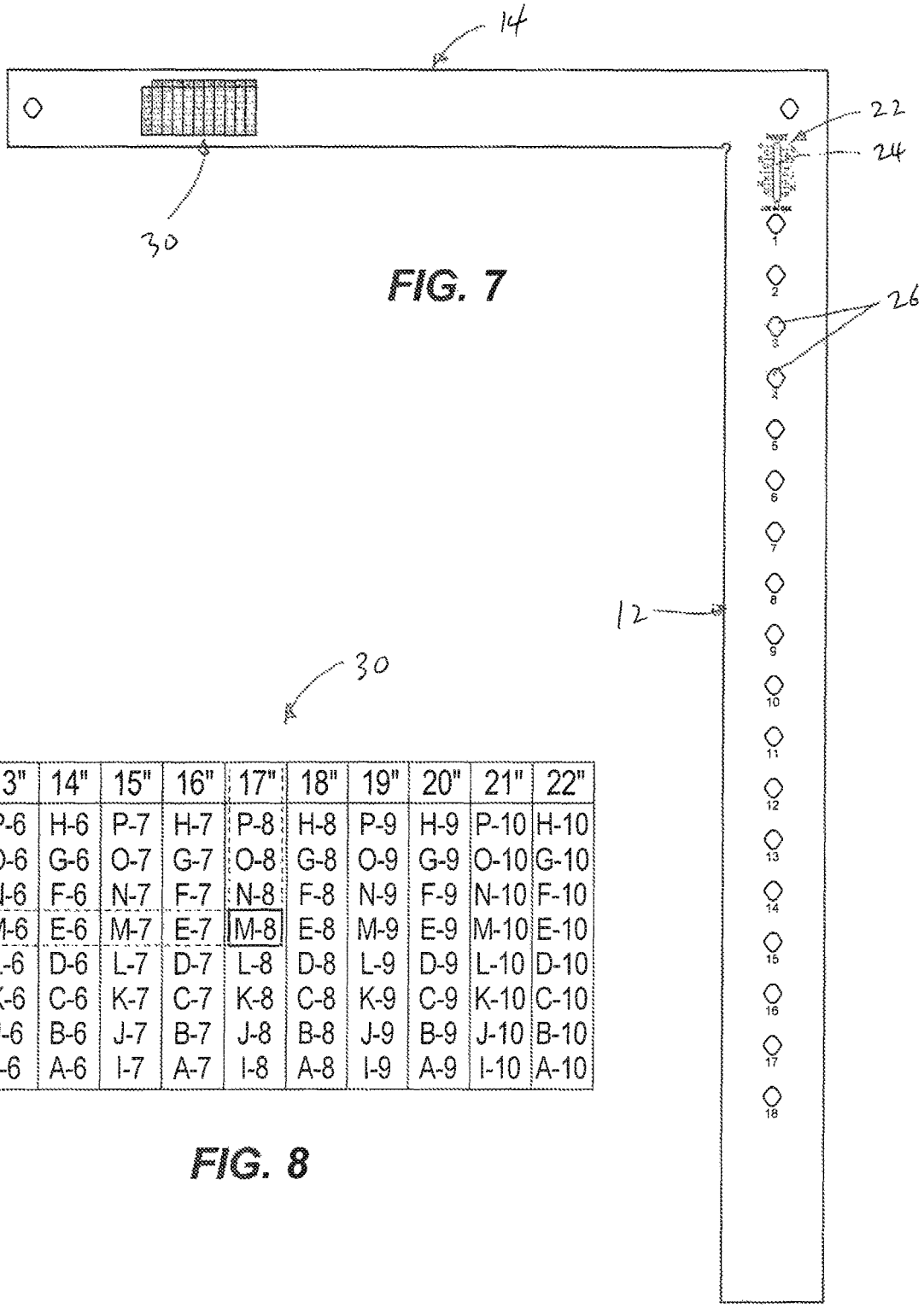
FIG. 7 is a plan view of an alternate embodiment of a layout tool, such as a square, that incorporates features in accordance with the present invention for making an arcuate mark on a work surface.
FIG. 8 is view illustrating a reference table on a blade or arm of the layout tool of FIG. 7.
Figure 9:
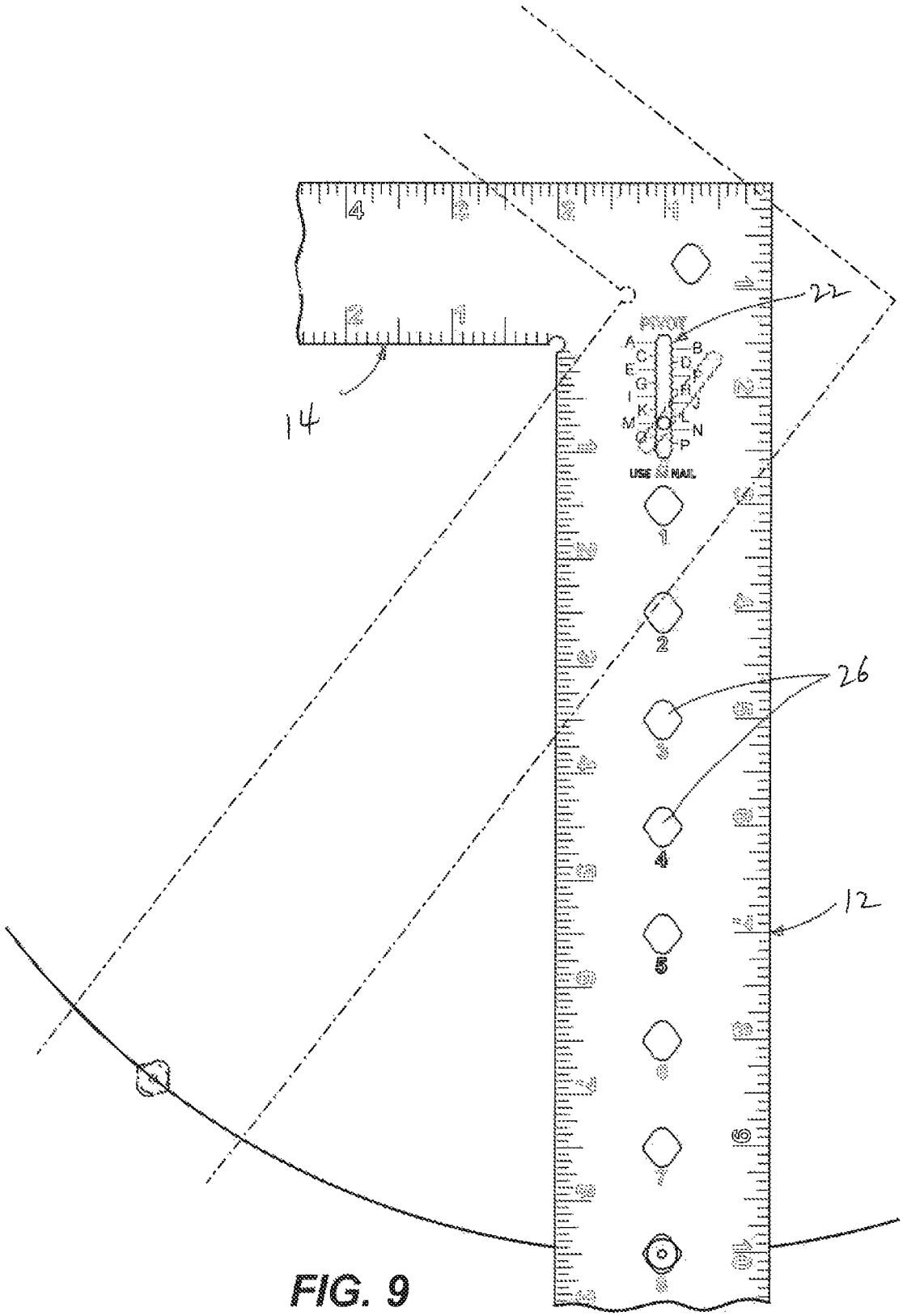
FIG. 9 is a partial plan view illustrating the manner in which the layout tool of FIG. 7 and the table of FIG. 8 are employed in order to make an arcuate mark on a work surface.

FIGS. 7-9 illustrate an alternative arrangement for determining the proper location of the nail N and the marking instrument M for making an arcuate mark on a workpiece using the square 10. In this embodiment, the mark openings 26 are spaced and marked the same as illustrated in FIGS. 1-6. However, the widened areas of the slot 24, instead of being marked with +/− fractional indicia, are marked with letter indicia. In the illustrated embodiment, the widened areas of the slot are marked with letter to lettered indicia A though P. A table 30 is provided on a surface of the square 10, such as on the arm 14. The table 30 has fractional indicia along the side and numerical indicia along the top. With this arrangement, the user determines from the table 30 the letter and number combination that corresponds to a desired radius. The user then inserts the nail N through the widened area of the slot 24 having a letter corresponding to the letter and number combination, and inserts the tip of the marking instrument M into the mark opening 26 that also corresponds to the letter and number combination. While the illustrated embodiment shows the table 30 as being printed on the surface of the square 10, it is understood that a table such as 30 may alternatively on an instruction sheet or user manual, or may be contained in an app on a smart phone, tablet or other device.

While the variable radius arc scribing feature of the present invention has been shown and described in relation to a square having two blades or arms that extend at an angle relative to each other, it is also contemplated that the variable radius arc scribing feature may be employed in a layout tool having a single arm, i.e., more in the form of a ruler within which slot 24 and mark openings 26 are formed.

It can this be appreciated that the square 10 provides the conventional functionality of a framing or layout square, but also includes the additional functionality of allowing.

It should be understood that the invention is not limited in its application to the details of construction and arrangements of the components set forth herein, and that the invention is capable of other embodiments and of being practiced or carried out in various ways. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

The invention claimed is:

1. A tool comprising:

an elongated planar arm;

a variable location pivot point arrangement on the elongated arm, wherein the variable location pivot point arrangement comprises an opening arrangement located adjacent an end defined by the elongated arm; and a plurality of mark openings formed in the elongated arm at a location spaced from the variable location pivot point arrangement, wherein the mark openings are spaced at regularly spaced locations along the length of the elongated arm;

wherein a position fixing member is adapted to be engaged with the variable location pivot point arrangement to fix the position of the tool on a workpiece at a pivot point defined by the position fixing member, and wherein a marking instrument is adapted to be engaged within one of the mark openings, wherein pivoting movement of the tool on the workpiece about the pivot point results in the marking instrument making an arcuate mark on the workpiece at a radius defined by the location of the position fixing member relative to the mark opening within which the marking instrument is engaged;

wherein a predetermined location along the length of the opening arrangement corresponds to a predetermined radius relative to each of the mark openings, and wherein locations along the length of the opening arrangement toward the mark openings correspond to fractionally smaller radii relative to the predetermined radius for each of the mark openings, and locations along the length of the opening arrangement away from the mark openings correspond to fractionally larger radii relative to the predetermined radius for each of the mark openings; and wherein the length of the opening arrangement corresponds to the space between adjacent mark openings, and wherein the opening arrangement is positioned relative to the mark openings such that a midpoint of the opening arrangement corresponds to the predetermined radius relative to each of the mark openings.

2. The tool of claim 1, wherein the elongated planar arm comprises a first elongated planar arm, and further comprising a second elongated planar arm extending at an angle from an end defined by the first elongated planar arm.

3. The tool of claim 2, wherein the second elongated arm extends at a right angle relative to the first elongated arm.

4. The tool of claim 1, wherein the opening arrangement comprises a slot extending through the elongated planar arm.

5. The tool of claim 4, wherein the slot defines serrated sides that are configured to receive the position fixing member at discrete locations along a length defined by the slot.

6. A tool comprising:

an elongated planar arm;

a variable location pivot point arrangement on the elongated planar arm, wherein the variable location pivot point arrangement comprises a slot extending through the elongated planar arm, wherein the slot has serrated sides; and a plurality of mark openings formed in the elongated planar arm at a location spaced from the variable location pivot point arrangement;

wherein a position fixing member is adapted to be engaged with the variable location pivot point arrangement to fix the position of the tool on a workpiece at a pivot point defined by the position fixing member, and wherein a marking instrument is adapted to be engaged within one of the mark openings, wherein pivoting movement of the tool on the workpiece about the pivot point results in the marking instrument making an arcuate mark on the workpiece at a radius defined by the location of the position fixing member relative to the mark opening within which the marking instrument is engaged;

wherein the serrated sides of the slot are configured to receive the position fixing member at discrete locations along a length defined by the slot.

7. The tool of claim 6, wherein the position fixing member comprises a nail, wherein the nail is adapted to be positioned within the slot at a desired location along the length of the slot and driven into the workpiece.

8. The tool of claim 6, wherein the mark openings are spaced at regularly spaced locations along the length of the elongated planar arm.

9. A tool comprising:

an elongated planar arm;

a variable location pivot point arrangement on the elongated planar arm, wherein the variable location pivot point arrangement comprises an opening arrangement located adjacent an end defined by the elongated planar arm; and a plurality of mark openings formed in the elongated planar arm at a location spaced from the variable location pivot point arrangement, wherein the mark openings are spaced at regularly spaced locations along the length of the elongated planar arm;

wherein a position fixing member is adapted to be engaged with the variable location pivot point arrangement to fix the position of the tool on a workpiece at a pivot point defined by the position fixing member, and wherein a marking instrument is adapted to be engaged within one of the mark openings, wherein pivoting movement of the tool on the workpiece about the pivot point results in the marking instrument making an arcuate mark on the workpiece at a radius defined by the location of the position fixing member relative to the mark opening within which the marking instrument is engaged;

wherein the variable location pivot point arrangement comprises a slot extending through the elongated planar arm, wherein the slot defines serrated sides that are configured to receive the position fixing member at discrete locations along a length defined by the slot.

10. The tool of claim 9, wherein a predetermined location along the length of the slot corresponds to a predetermined radius relative to each of the mark openings, and wherein locations along the length of the slot toward the mark openings correspond to fractionally smaller radii relative to the predetermined radius for each of the mark openings, and locations along the length of the slot away from the mark openings correspond to fractionally larger radii relative to the predetermined radius for each of the mark openings.

11. The tool of claim 9, wherein the length of the slot corresponds to the space between adjacent mark openings, and wherein the slot is positioned relative to the mark openings such that a midpoint of the slot corresponds to the predetermined radius relative to each of the mark openings.

12. A method of marking an arc on a workpiece, comprising the acts of:

providing a tool having an elongated planar arm; a variable location pivot point arrangement on the elongated planar arm, wherein the variable location pivot point arrangement comprises an opening arrangement located adjacent an end defined by the elongated planar arm; and a plurality of mark openings formed in the elongated planar arm at a location spaced from the variable location pivot point arrangement;

engaging a position fixing member with the variable location pivot point arrangement and with the workpiece to fix the position of the tool on the workpiece at a pivot point defined by the position fixing member;

engaging a marking instrument within one of the mark openings; and pivoting the tool on the workpiece about the pivot point, wherein the marking instrument makes an arcuate mark on the workpiece at a radius defined by the location of the position fixing member relative to the mark opening within which the marking instrument is engaged;

wherein the opening arrangement comprises a slot extending through the elongated planar arm, wherein the slot defines serrated sides that are configured to receive the position fixing member at discrete locations along a length defined by the slot, wherein the act of engaging the position fixing member with the variable location pivot point arrangement and with the workpiece is carried out by inserting the position fixing member through the slot and into the workpiece, wherein selected serrations of the serrated sides of the slot function to fix the position of the position fixing member along the length of the slot.

13. The method of claim 12, wherein the elongated planar arm comprises a first elongated planar arm, and wherein the tool further includes a second elongated planar arm extending at an angle from an end defined by the first elongated planar arm.

14. The method of claim 12, wherein the position fixing member comprises a nail that is positioned by a user within the slot at a desired location along the length of the slot as defined by the selected serration of the serrated sides of the slot, and driven into the workpiece.

15. The method of claim 12, wherein the mark openings are spaced at regularly spaced locations along the length of the elongated planar arm and wherein a predetermined location along the length of the slot corresponds to a predetermined radius relative to each of the mark openings, and wherein engagement of the position fixing member within the slot toward the mark openings corresponds to fractionally smaller radii relative to the predetermined radius for each of the mark openings, and engagement of the position fixing member within the slot away from the mark openings corresponds to fractionally larger radii relative to the predetermined radius for each of the mark openings.

16. The method of claim 15, wherein the length of the slot corresponds to the space between adjacent mark openings, and wherein the slot is positioned relative to the mark openings such that a midpoint of the slot corresponds to the predetermined radius relative to each of the mark openings.

* * * * *